US005782707A

United States Patent [19]

Yamagishi et al.

[11] Patent Number: 5,782,707

[45] Date of Patent: Jul. 21, 1998

[54] THREE-PIECE SOLID GOLF BALL

[75] Inventors: Hisashi Yamagishi; Hiroshi Higuchi, both of Chichibu, Japan

[73] Assignee: Bridgestone Sports Co., Ltd., Tokyo, Japan

[21] Appl. No.: 812,925

[22] Filed: Mar. 10, 1997

[30] Foreign Application Priority Data

Mar. 11, 1996 [JP] Japan ..... 8-082121

[51] Int. Cl.[6] ..... A63B 37/06; A63B 37/12; A63B 37/14

[52] U.S. Cl. ..... 473/374; 473/373

[58] Field of Search ..... 473/373, 374, 473/378, 384

[56] References Cited

U.S. PATENT DOCUMENTS

| | | | |
|---|---|---|---|
| 4,431,193 | 2/1984 | Nesbitt | 473/374 |
| 5,048,838 | 9/1991 | Chikaraishi | 473/373 X |
| 5,273,286 | 12/1993 | Sun | 473/376 X |
| 5,439,227 | 8/1995 | Egashira et al. | 473/377 X |
| 5,601,503 | 2/1997 | Yamagishi et al. | 473/351 X |
| 5,688,191 | 11/1997 | Cavallaro et al. | 473/373 |

*Primary Examiner*—George J. Marlo
*Attorney, Agent, or Firm*—Sughrue, Mion, Zinn, Macpeak & Seas, PLLC

[57] ABSTRACT

The invention provides a three-piece solid golf ball featuring an increased flight distance on driver shots and improved control on approach shots. In a three-piece solid golf ball consisting of a solid core, an intermediate layer, and a cover, provided that hardness is measured by a JIS-C scale hardness meter, the core center hardness is up to 75 degrees, the core surface hardness is up to 85 degrees, the core surface hardness is higher than the core center hardness by 8 to 20 degrees, the intermediate layer hardness is higher than the core surface hardness by at least 5 degrees, and the cover hardness is lower than the intermediate layer hardness by at least 5 degrees.

6 Claims, 2 Drawing Sheets

THREE-PIECE SOLID GOLF BALL

BACKGROUND OF THE INVENTION

1. Field of the Invention

This invention relates to a three-piece solid golf ball of the three-layer structure comprising a solid core, an intermediate layer, and a cover and more particularly, to such a three-piece solid golf ball which features an increased flight distance on full shots with a driver and improved control on approach shots with No. 5 iron or sand wedge.

2. Prior Art

From the past, two-piece solid golf balls consisting of a solid core and a cover are used by many golfers because of their flight distance and durability features. In general, two-piece solid golf balls give hard hitting feel as compared with wound golf balls, and are inferior in feel and control due to quick separation from the club head. For this reason, many professional golfers and skilled amateur golfers who prefer feel and control use wound golf balls rather than two-piece solid golf balls. The wound golf balls are, however, inferior in carry and durability to the solid golf balls.

More particularly, when two-piece solid golf balls are subject to full shots with a club having a relatively large loft angle, the ball flight is mainly governed by the club loft rather than the ball itself so that spin acts on most balls to prevent the balls from too much rolling. However, on approach shots over a short distance of 30 to 50 yards, rolling or control substantially differs among balls. The major cause of this difference is not related to the basic structure of the ball, but to the cover material. Then some two-piece solid golf balls use a cover of a relatively soft material in order to improve control on approach shots, but at the sacrifice of flight distance.

Controllability is also needed on full shots with a driver. If a soft cover is used as a result of considering too much the purpose of improving spin properties upon control shots such as approach shots with No. 5 iron and sand wedge, hitting the ball with a driver, which falls within an increased deformation region, will impart too much spin so that the ball may fly too high, resulting in a rather reduced flight distance. On the other hand, if the spin rate is too low, there arises a problem that the ball on the descending course will prematurely drop, adversely affecting the ultimate flight distance too. As a consequence, an appropriate spin rate is still necessary upon driver shots.

Anyway, the prior art two-piece solid golf balls fail to fully meet the contradictory demands of players, the satisfactory flight performance that the ball acquires an adequate spin rate upon full shots with a driver and the ease of control that the ball acquires a high spin rate upon approach shots with No. 5 iron and sand wedge.

SUMMARY OF THE INVENTION

An object of the present invention is to provide a three-piece solid golf ball which features an increased flight distance on full shots with a driver and improved control on approach shots with No. 5 iron or sand wedge.

Making extensive investigations on a three-piece solid golf ball of the three-layer structure comprising a solid core, an intermediate layer, and a cover, we have found that the above object is attained by optimizing the hardness distribution of the core, forming a hard intermediate layer between the core and the soft cover, and adjusting a percent dimple surface occupation. By virtue of the synergistic effect of these factors, the resulting golf ball travels an increased flight distance on full shots with a driver and is well controllable on approach shots with No. 5 iron or sand wedge.

More specifically, we have found that the following advantages are obtained in a three-piece solid golf ball of the three-layer structure comprising a solid core, an intermediate layer, and a cover, when the solid core, intermediate layer, and cover each have a hardness as measured by a JIS-C scale hardness meter, the core center hardness is up to 75 degrees, the core surface hardness is up to 85 degrees, the core surface hardness is higher than the core center hardness by 8 to 20 degrees, the intermediate layer hardness is higher than the core surface hardness by at least 5 degrees, and the cover hardness is lower than the intermediate layer hardness by at least 5 degrees. Upon deformation in an increased deformation region (associated with full shots with a driver), the presence of a hard intermediate layer between a soft deformable cover and a soft core ensuring soft feel is effective for reducing the energy loss by excessive deformation of the core and thereby enabling to form a structure of efficient restitution while maintaining the softness of the ball as a whole. Then the ball will travel an increased flight distance upon full shots with a driver. Although a soft cover is used, the ball gains an appropriate spin rate and is free of shortage of flight distance. At the same time, in a reduced deformation region (associated with approach shots), the ball gains an increased spin rate and is well controllable. Additionally, by adjusting dimples such that the percent surface occupation of dimples in the cover surface is at least 62% and an index (Dst) of overall dimple surface area is at least 4, and optimizing the dimple pattern, the flight properties (flight distance and flight-in-wind) of the golf ball are further enhanced. By virtue of the synergistic effect of these factors, the resulting golf ball covers an increased flight distance on full shots with a driver and is well controllable on approach shots with No. 5 iron or sand wedge, that is, satisfies the contradictory demands of players.

Therefore, according to the present invention, there is provided a three-piece solid golf ball of the three-layer structure comprising a solid core, an intermediate layer, and a cover, having a plurality of dimples in the ball surface. Provided that the solid core at its surface and center, the intermediate layer, and the cover each have a hardness as measured by a JIS-C scale hardness meter, the core center hardness is up to 75 degrees, the core surface hardness is up to 85 degrees, the core surface hardness is higher than the core center hardness by 8 to 20 degrees, the intermediate layer hardness is higher than the core surface hardness by at least 5 degrees, and the cover hardness is lower than the intermediate layer hardness by at least 5 degrees. The dimples occupy at least 62% of the ball surface.

In one preferred embodiment, the dimples in the ball surface total in number to 360 to 450 and include at least two types of dimples having different diameters. An index (Dst) of overall dimple surface area given by the following expression (1) is at least 4, $$Dst = \frac{n \sum_{k-1}^{n} [(Dmk^2 + Dpk^2) x V_0 k x Nk]}{4R^2} \quad (1)$$

wherein R is a ball radius, n is the number of dimple types, Dmk is a diameter of dimples k, Dpk is a depth of dimples k, Nk is the number of dimples k wherein k=1, 2, 3, . . . n, and $V_0$ is the volume of the dimple space below a plane circumscribed by the dimple edge divided by the volume of a cylinder whose bottom is the plane and whose height is the maximum depth of the dimple from the bottom.

DETAILED DESCRIPTION OF THE INVENTION

Figure 1:
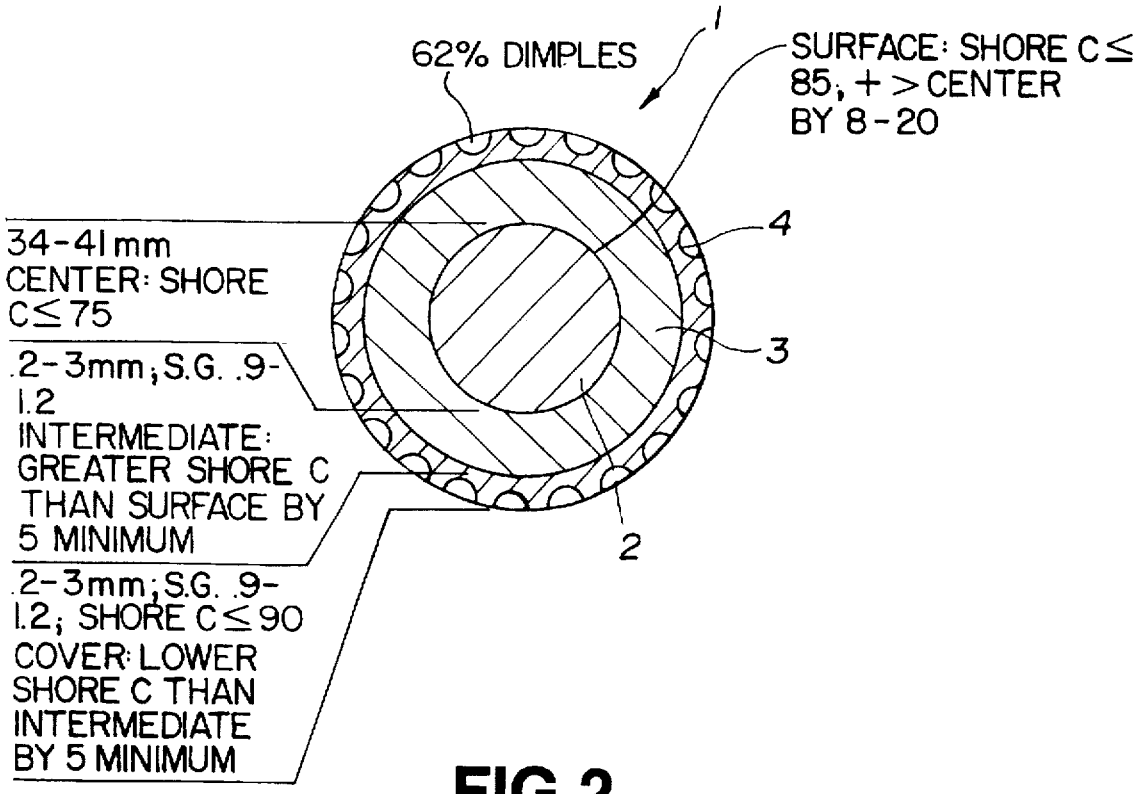
FIG. 1 is a schematic cross-sectional view of a three-piece solid golf ball according to one embodiment of the invention.

Referring to FIG. 1, a three-piece solid golf ball 1 according to the invention is illustrated as comprising a solid core 2 having an optimized hardness distribution, a hard intermediate layer 3, and a soft cover 4.

In the golf ball 1 of the invention, the hardness distribution of the solid core 2 is optimized. More particularly, the core 2 is formed to have a center hardness of up to 75 degrees, preferably 60 to 73 degrees, more preferably 63 to 69 degrees as measured by a JIS-C scale hardness meter. The core 2 is also formed to have a surface hardness of up to 85 degrees, preferably 70 to 83 degrees, more preferably 73 to 80 degrees. If the core center hardness exceeds 75 degrees and the surface hardness exceeds 85 degrees, the hitting feel becomes hard, contradicting the object of the invention. It is noted that the hardness referred to herein is JIS-C scale hardness unless otherwise stated.

The core is formed herein such that the surface hardness is higher than the center hardness by 8 to 20 degrees, preferably 10 to 18 degrees. A hardness difference of less than 8 degrees would result in a hard hitting feel provided that the ball hardness and the core surface hardness are fixed. A hardness difference of more than 20 degrees would fail to provide sufficient restitution provided that the ball hardness and the core surface hardness are fixed. The hardness distribution establishing such a hardness difference between the surface and the center of the core ensures that the core surface formed harder than the core center is effective for preventing excessive deformation of the core and efficiently converting distortion energy into reaction energy when the ball is deformed upon impact. Additionally, a pleasant feeling is obtainable from the core center softer than the core surface.

The hardness distribution of the solid core is not limited insofar as the core is formed such that the core surface is harder than the core center by 8 to 20 degrees. It is preferable from the standpoint of efficient energy transfer that the core is formed such that the core becomes gradually softer from its surface toward its center.

The solid core preferably has a diameter of 34 to 41 mm, especially 34.5 to 40 mm. No particular limit is imposed on the overall hardness, weight and specific gravity of the core and they are suitably adjusted insofar as the objects of the invention are attainable. Usually, the core has an overall hardness corresponding to a distortion of 2.5 to 4.5 mm, especially 2.8 to 4 mm under a load of 100 kg applied, and a weight of 20 to 40 grams, especially 23 to 37 grams.

In the practice of the invention, no particular limit is imposed on the core-forming composition from which the solid core is formed. The solid core may be formed using a base rubber, a crosslinking agent, a co-crosslinking agent, and an inert filler as used in the formation of conventional solid cores. The base rubber used herein may be natural rubber and/or synthetic rubber conventionally used in solid golf balls although 1,4-cis-polybutadiene having at least 40% of cis-structure is especially preferred in the invention. The polybutadiene may be blended with a suitable amount of natural rubber, polyisoprene rubber, styrenebutadiene rubber or the like if desired. The crosslinking agent includes organic peroxides such as dicumyl peroxide, di-t-butyl peroxide, and 1,1-bis(t-butylperoxy)-3,3,5-trimethylcyclohexane, with a blend of dicumyl peroxide and 1,1-bis(t-butylperoxy)-3,3,5-trimethylcyclohexane being preferred. In order to form a solid core so as to have the above-defined hardness distribution, it is preferable to use a blend of dicumyl peroxide and 1,1-bis(t-butylperoxy)-3,3,5-trimethylcyclohexane as the crosslinking agent and the step of vulcanizing at 160° C. for 20 minutes. It is noted that the amount of the crosslinking agent blended is suitably determined although it is usually about 0.5 to 3 parts by weight per 100 parts by weight of the base rubber. The co-crosslinking agent used herein is not critical. Examples include metal salts of unsaturated fatty acids, inter alia, zinc and magnesium salts of unsaturated fatty acids having 3 to 8 carbon atoms (e.g., acrylic acid and methacrylic acid), with zinc acrylate being especially preferred. Examples of the inert filler include zinc oxide, barium sulfate, silica, calcium carbonate, and zinc carbonate, with zinc oxide and barium sulfate being often used. The amount of the filler blended is usually up to 40 parts by weight per 100 parts by weight of the base rubber although the amount largely varies with the specific gravity of the core and cover, the standard weight of the ball, and other factors and is not critical. In the practice of the invention, the overall hardness and weight of the core can be adjusted to optimum values by properly adjusting the amounts of the crosslinking agent and filler (typically zinc oxide and barium sulfate) blended.

The core-forming composition obtained by blending the above-mentioned components is generally milled in a conventional mixer such as a Banbury mixer and roll mill, compression or injection molded in a core mold, and then heat cured under the above-mentioned temperature condition, whereby a solid core having an optimum hardness distribution is obtainable.

The intermediate layer 3 enclosing the core 2 is preferably formed to a JIS-C hardness of 75 to 100 degrees, more preferably 80 to 98 degrees. The intermediate layer is formed to a hardness higher than the core surface hardness by at least 5 degrees, preferably 5 to 20 degrees, more preferably by 7 to 18 degrees. A hardness difference of less than 5 degrees would fail to provide sufficient restitution whereas a hardness difference of more than 20 degrees would result in a dull and rather hard hitting feel. The restitution of the core can be maintained by forming the intermediate layer to a higher hardness than the core surface hardness.

The gage, specific gravity and other parameters of the intermediate layer may be properly adjusted insofar as the objects of the invention are attainable. Preferably the gage is 0.2 to 3 mm, especially 0.7 to 2.3 mm and the specific gravity is 0.9 to less than 1.2, especially 0.94 to 1.15.

Since the intermediate layer 3 serves to compensate for a loss of restitution of the solid core which is formed soft, it is formed of a material having improved restitution insofar as a hardness within the above-defined range is achievable. Use is preferably made of a blend of ionomer resins such as Himilan (manufactured by Mitsui-duPont Polychemical K.K.) and Surlyn (E.I. duPont) as will be described later in Table 2. An intermediate layer-forming composition may be obtained by adding to the ionomer resin, additives, for example, an inorganic filler such as zinc oxide and barium sulfate as a weight adjuster and a coloring agent such as titanium dioxide.

The cover 4 enclosing the intermediate layer 3 must be formed to a lower hardness than the intermediate layer. That is, the cover has a hardness lower than the intermediate layer hardness by at least 5 degrees. Additionally, the cover is preferably formed to a JIS-C hardness of up to 90 degrees, more preferably 70 to 90 degrees, most preferably 75 to 87 degrees when spin properties in an approach range are of much account. A cover hardness in excess of 90 degrees on JIS-C scale would adversely affect the spin properties in an approach range so that professional and skilled amateur players who prefer accurate control reject use in the game. A cover hardness of less than 70 degrees would result in a ball losing restitution.

The gage, specific gravity and other parameters of the cover may be properly adjusted insofar as the objects of the invention are attainable. Preferably the gage is 0.2 to 3 mm, especially 0.7 to 2.3 mm and the specific gravity is 0.9 to less than 1.2, especially 0.93 to 1.15. The gage of the intermediate layer and cover combined is preferably 2 to 4.5 mm, especially 2.2 to 4.2 mm.

The cover composition is not critical and the cover may be formed of any of well-known stock materials having appropriate properties as golf ball cover stocks. For example, ionomer resins, polyester elastomers, and polyamide elastomers may be used alone or in admixture with urethane resins and ethylene-vinyl acetate copolymers. Thermoplastic resin base compositions are especially preferred. UV absorbers, antioxidants and dispersing aids such as metal soaps may be added to the cover composition if necessary. The method of applying the cover is not critical. The cover is generally formed over the core by surrounding the core by a pair of preformed hemispherical cups followed by heat compression molding or by injection molding the cover composition over the core.

Like conventional golf balls, the three-piece solid golf ball of the invention is formed with a multiplicity of dimples in the cover surface. The golf ball of the invention is formed with dimples such that, provided that the golf ball is a sphere defining a phantom spherical surface, the proportion of the surface area of the phantom spherical surface delimited by the edge of respective dimples relative to the overall surface area of the phantom spherical surface, that is the percent occupation of the ball surface by the dimples is at least 62%, preferably 63 to 85%. With a dimple occupation of less than 62%, the above-mentioned flight performance, especially an increased flight distance is not expectable. The total number of dimples is preferably 360 to 450, more preferably 370 to 440. There may be two or more types of dimples which are different in diameter and/or depth. It is preferred that the dimples have a diameter of 2.2 to 4.5 mm and a depth of 0.12 to 0.23 mm. The arrangement of dimples may be selected from regular octahedral, dodecahedral, and icosahedral arrangements as in conventional golf balls while the pattern formed by thus arranged dimples may be any of square, hexagon, pentagon, and triangle patterns.

Moreover, the dimples are preferably formed such that $V_0$ is 0.39 to 0.6, especially 0.41 to 0.58 wherein $V_0$ is the volume of the dimple space below a plane circumscribed by the dimple edge divided by the volume of a cylinder whose bottom is the plane and whose height is the maximum depth of the dimple from the bottom.

Figure 2:
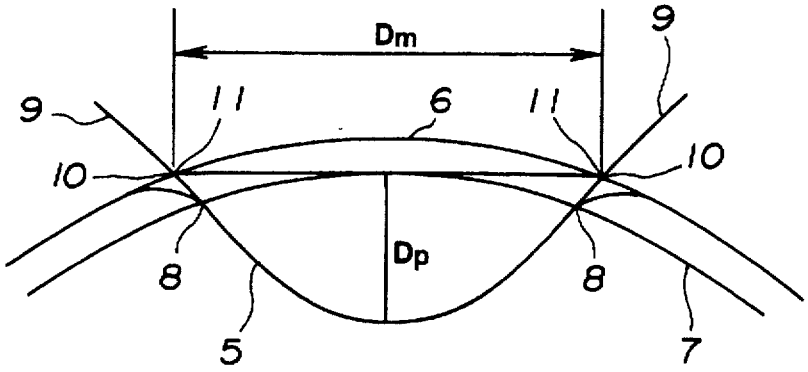
FIG. 2 is a schematic cross-sectional view of a dimple illustrating how to calculate $V_0$.
Figure 3:
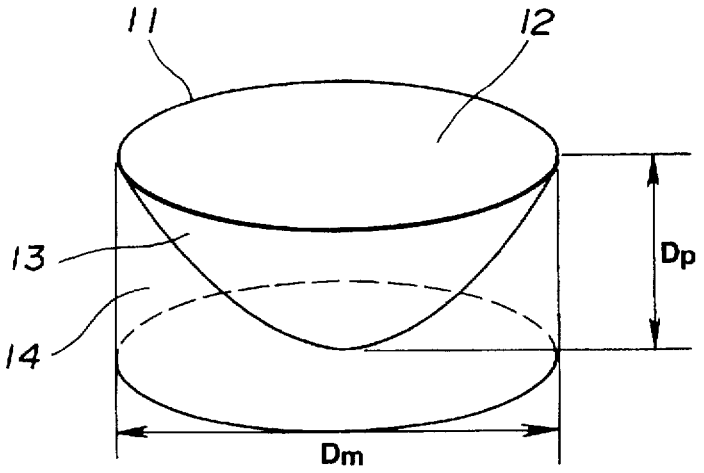
FIG. 3 is a perspective view of the same dimple.
Figure 4:
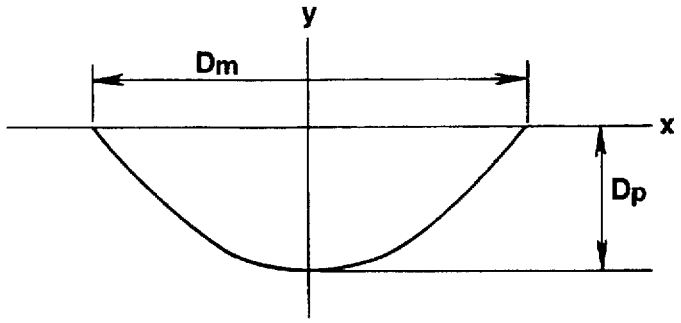
FIG. 4 is a cross-sectional view of the same dimple.

Now the shape of dimples is described in further detail. In the event that the planar shape of a dimple is circular, as shown in FIG. 2, a phantom sphere 6 having the ball diameter and another phantom sphere 7 having a diameter smaller by 0.16 mm than the ball diameter are drawn in conjunction with a dimple 5. The circumference of the other sphere 7 intersects with the dimple 5 at a point 8. A tangent 9 at intersection 8 intersects with the phantom sphere 6 at a point 10 while a series of intersections 6 define a dimple edge 11. The dimple edge 11 is so defined for the reason that otherwise, the exact position of the dimple edge cannot be determined because the actual edge of the dimple 5 is rounded. The dimple edge 11 circumscribes a plane 12 (having a diameter Dm). Then as shown in FIGS. 3 and 4, the dimple space 13 located below the plane 12 has a volume Vp. A cylinder 14 whose bottom is the plane 12 and whose height is the maximum depth Dp of the dimple from the bottom or circular plane 12 has a volume Vq. The ratio $V_0$ of the dimple space volume Vp to the cylinder volume Vq is calculated.

$$Vp = \int_0^{\frac{Dm}{2}} 2\pi xy dx$$

$$Vq = \frac{\pi Dm^2 Dp}{4}$$

$$V_0 = \frac{Vp}{Vq}$$

In the event that the planar shape of a dimple is not circular, the maximum diameter or length of a dimple is determined, the plane projected shape of the dimple is assumed to be a circle having a diameter equal to this maximum diameter or length, and $V_0$ is calculated as above based on this assumption.

Furthermore, provided that the number of types of dimples formed in the ball surface is n wherein $n \geqq 2$, preferably n=2 to 6, more preferably n=3 to 5, and the respective types of dimples have a diameter Dmk, a maximum depth Dpk, and a number Nk wherein k=1, 2, 3, . . . , n, the golf ball of the invention prefers that an index Dst of overall dimple surface area given by the following equation (1) is at least 4, more preferably 4 to 8.

$$Dst = \frac{\sum_{k-1}^{n} [(Dmk^2 + Dpk^2) x V_0 k x Nk]}{4R^2} \quad (1)$$

Note that R is a ball radius, $V_0$ is as defined above, and Nk is the number of dimples k. The index Dst of overall dimple surface area is useful in optimizing various dimple parameters so as to allow the golf ball of the invention having the above-mentioned solid core and cover to travel a further distance. When the index Dst of overall dimple surface area is equal to or greater than 4, the aerodynamics (flying distance and flight-in-wind) of the golf ball are further enhanced.

While the three-piece solid golf ball of the invention is constructed as mentioned above, other ball parameters including weight and diameter are properly determined in accordance with the Rules of Golf.

The three-piece solid golf ball of the invention will travel an increased flight distance on full shots with a driver and be easy to control on approach shots with No. 5 iron or sand wedge.

EXAMPLE

Examples of the present invention are given below together with Comparative Examples by way of illustration and not by way of limitation. The amounts of components in the core, intermediate layer, and cover as reported in Tables 1 and 2 are all parts by weight.

Examples 1–5 and Comparative Examples 1–4

Solid cores, Nos. 1 to 6, were prepared by kneading components in the formulation shown in Table 1 to form a rubber composition and molding and vulcanizing it in a mold under conditions as shown in Table 1. The cores were measured for JIS-C hardness and diameter, with the results shown in Tables 3 and 4. The JIS-C hardness of the core was measured by cutting the core into halves, and measuring the hardness at the center (center hardness) and the hardness at core surface or spherical surface (surface hardness). The result is an average of five measurements.

TABLE 1

| Core No. | 1 | 2 | 3 | 4 | 5 | 6 |
|---|---|---|---|---|---|---|
| Formulation | | | | | | |
| Cis-1,4-polybutadiene rubber | 100 | 100 | 100 | 100 | 100 | 100 |
| Zinc acrylate | 24 | 24 | 25 | 29 | 15 | 34 |
| Zinc oxide | 29 | 26 | 34 | 27 | 33 | 25 |
| Dicumyl peroxide | 1 | 1 | 1 | 1 | 1 | 0 |
| *1 | 0.3 | 0.3 | 0.3 | 0.3 | 0.3 | 1 |
| Vulcanizing conditions | | | | | | |
| Temperature, °C. | 160 | 160 | 160 | 160 | 160 | 155 |
| Time, min. | 20 | 20 | 20 | 20 | 20 | 15 |
| Core hardness*2, mm | 3.7 | 3.7 | 3.5 | 3 | 5.7 | 2.2 |

*1 1,1-bis(t-butylperoxy)-3,3,5-trimethylcyclohexane (trade name Perhexa 3M-40 manufactured by Nippon Oil and Fats K.K.)
*2 distortion under a load of 100 kg Next, compositions for the intermediate layer and cover were milled as shown in Table 2 and injection molded over the solid core and the intermediate layer, respectively, obtaining three-piece solid golf balls as shown in Table 4. At the same time as injection molding, two or three types of dimples were indented in the cover surface as shown in Table 3. Whenever the intermediate layer and cover were molded, the intermediate layer and cover were measured for JIS-C hardness, specific gravity and gage. The results are also shown in Table 4.

TABLE 2

Intermediate layer and cover formulations (pbw)

| | A | B | C | D | E |
|---|---|---|---|---|---|
| Himilan 1557*3 | 50 | — | 50 | — | — |
| Himilan 1601*3 | — | — | 50 | — | — |
| Himilan 1605*3 | 50 | 50 | — | — | — |
| Himilan 1855*3 | — | — | — | 50 | 50 |
| Himilan 1856*3 | — | — | — | — | 50 |
| Himilan 1706*3 | — | 50 | — | — | — |
| Surlyn 8120*4 | — | — | — | 50 | — |

*3 ionomer resin manufactured by Mitsui-duPont Polychemical K.K.
*4 ionomer resin manufactured by E.I. duPont of USA

TABLE 3

| Dimple set | Diameter (mm) | Depth (mm) | $V_0$ | Number | Dst | Surface occupation (%) |
|---|---|---|---|---|---|---|
| I | 4.000 | 0.200 | 0.50 | 72 | 4.539 | 75 |
| | 3.850 | 0.193 | 0.50 | 200 | | |
| | 3.400 | 0.170 | 0.50 | 120 | | |
| | | | total | 392 | | |
| II | 3.800 | 0.205 | 0.48 | 162 | 4.263 | 74 |
| | 3.600 | 0.194 | 0.48 | 86 | | |
| | 3.450 | 0.186 | 0.48 | 162 | | |
| | | | total | 410 | | |
| III | 3.400 | 0.195 | 0.39 | 360 | 2.148 | 61 |
| | 2.450 | 0.195 | 0.39 | 140 | | |
| | | | total | 500 | | |

The thus obtained golf balls were evaluated for flight performance, spin, feel, spin control, and durability by the following tests.

Flight performance

Using a hitting machine manufactured by True Temper Co., the ball was actually hit with a driver (#W1) at a head speed of 45 m/s (HS45) and 35 m/sec. (HS35) to measure a spin, carry, and total distance.

Feel

Five golfers with a head speed of 45 m/sec. (HS45) and five golfers with a head speed of 35 m/sec. (HS35) actually hit the balls. The ball was rated according to the following criterion.

○:soft

Δ:ordinary

X:hard

Spin control

Three professional golfers actually hit the ball with No. 5 iron (#I5) to examine intentional hook and slice and stoppage on the green and also with a sand wedge (#SW) to examine spin on 30 and 80 yard shots (that is, stoppage on the green and ease of capture of the ball upon impact). An overall rating of the ball was derived from these spin control factors. The ball was rated "○" for easy control, "Δ" for ordinary, and "X" for difficult control.

Durability

Durability against continuous strikes and durability against cutting were evaluated in combination. The ball was rated according to the following criterion.

○:excellent

Δ:ordinary

X:inferior

TABLE 4

| | Examples | | | | | Comparative Examples | | | |
|---|---|---|---|---|---|---|---|---|---|
| | 1 | 2 | 3 | 4 | 5 | 1 | 2 | 3 | 4 |
| Core | | | | | | | | | |
| Type | 1 | 2 | 3 | 4 | 1 | 1 | 5 | 6 | 4 |
| Center hardness A (JIS-C) | 64 | 64 | 65 | 68 | 64 | 64 | 52 | 80 | 68 |
| Surface hardness B (JIS-C) | 75 | 75 | 77 | 82 | 75 | 75 | 62 | 90 | 82 |
| B − A | 11 | 11 | 12 | 14 | 11 | 11 | 10 | 10 | 14 |
| Diameter (mm) | 36.5 | 37.9 | 35.1 | 37.9 | 36.5 | 36.5 | 36.5 | 36.5 | 37.9 |
| Intermediate layer | | | | | | | | | |
| Type | A | A | B | B | C | A | D | B | A |
| Hardness C (JIS-C) | 86 | 86 | 93 | 93 | 83 | 86 | 75 | 93 | 86 |
| C − B | 11 | 11 | 16 | 11 | 8 | 11 | 13 | 3 | 4 |
| Specific gravity | 0.97 | 0.97 | 0.97 | 0.97 | 0.97 | 0.97 | 0.97 | 0.97 | 0.97 |
| Gage (mm) | 1.6 | 1.2 | 1.8 | 1.2 | 1.6 | 1.6 | 1.6 | 1.6 | 1.8 |
| Cover | | | | | | | | | |
| Type | E | E | C | F | D | E | B | A | B |
| Hardness D (JIS-C) | 80 | 80 | 83 | 80 | 75 | 81 | 93 | 86 | 93 |
| D − C | −6 | −6 | −10 | −13 | −8 | −5 | 18 | −7 | 7 |
| Specific gravity | 0.97 | 0.97 | 0.97 | 0.97 | 0.97 | 0.97 | 0.97 | 0.97 | 0.97 |
| Gage (mm) | 1.5 | 1.5 | 2.0 | 1.5 | 1.5 | 1.5 | 1.5 | 3.5 | 2.0 |
| Intermediate layer/cover combined gage (mm) | 3.1 | 2.7 | 3.8 | 2.7 | 3.1 | 3.1 | 3.1 | 5.1 | 3.8 |
| Dimple set | I | I | II | II | II | III | I | I | I |
| Ball outer diameter (mm) | 42.7 | 42.7 | 42.7 | 42.7 | 42.7 | 42.7 | 42.7 | 42.7 | 42.7 |
| #W1/HS45 | | | | | | | | | |
| Spin (rpm) | 2800 | 2750 | 2900 | 2700 | 2950 | 2800 | 2650 | 2700 | 2680 |
| Carry (m) | 209.0 | 210.0 | 210.0 | 209.5 | 210.5 | 207.0 | 209.0 | 207.5 | 208.5 |
| Total (m) | 223.0 | 224.5 | 223.5 | 222.0 | 224.0 | 218.0 | 221.0 | 217.0 | 218.0 |
| Feel | ○ | ○ | ○ | ○ | ○ | ○ | Δ | X | X |
| #W1/HS35 | | | | | | | | | |
| Spin (rpm) | 4600 | 4400 | 4650 | 4700 | 4750 | 4600 | 4600 | 4680 | 4630 |
| Carry (m) | 142.0 | 144.0 | 142.5 | 144.0 | 143.0 | 138.0 | 142.5 | 139.0 | 140.0 |
| Total (m) | 150.0 | 153.0 | 150.0 | 152.5 | 152.0 | 145.0 | 149.5 | 145.5 | 148.0 |
| Feel | ○ | ○ | ○ | ○ | Δ | ○ | Δ | X | X |
| Spin control | ○ | ○ | ○ | ○ | ○ | ○ | X | Δ | X |
| Durability | ○ | ○ | ○ | ○ | ○ | ○ | X | Δ | Δ |

Note:
A hardness difference is represented by (B − A), (C − B), and (D − C). (B − A) is equal to the core surface hardness minus the core center hardness; (C − B) is equal to the intermediate layer hardness minus the core surface hardness; and (D − C) is equal to the cover hardness minus the intermediate layer hardness.

As is evident from Table 4, the ball of Comparative Example 1 which is identical with the ball of Example 1 except for the dimple set is unsatisfactory in flight distance because the dimple surface occupation is as low as 61%. The ball of Comparative Example 2 is inferior in hitting feel, spin control, and durability since the cover is harder than the intermediate layer. The ball of Comparative Example 3 is unsatisfactory in flight distance and hitting feel because the core surface hardness and core center hardness are too high and the hardness difference between the intermediate layer and the core surface is too small. The ball of Comparative Example 4 is inferior in flight distance, hitting feel, and spin control since the cover is harder than the intermediate layer and the intermediate layer is insufficiently harder than the core.

In contrast, the golf balls of Examples 1 to 5 within the scope of the invention receive an appropriate spin rate upon full shots with a driver to travel a longer flight distance, are easy to spin control upon approach shots, and are excellent in both hitting feel and durability.

Japanese Patent Application No. 82121/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A three-piece solid golf ball of the three-layer structure comprising a solid core, an intermediate layer, and a cover, having a plurality of dimples in the ball surface wherein the solid core, intermediate layer, and cover each have a hardness as measured by a JIS-C scale hardness meter wherein the core center hardness is up to 75 degrees, the core surface hardness is up to 85 degrees, the core surface hardness is higher than the core center hardness by 8 to 20 degrees, the intermediate layer hardness is higher than the core surface hardness by at least 5 degrees, and the cover hardness is lower than the intermediate layer hardness by at least 5 degrees, and the dimples occupy at least 62% of the ball surface.

2. The three-piece solid golf ball of claim 1 wherein said intermediate layer has a gage of 0.2 to 3 mm and a specific gravity of 0.9 to less than 1.2.

3. The three-piece solid golf ball of claim 1 wherein said cover is based on a thermoplastic resin and has a hardness of up to 90 degrees as measured by the JIS-C scale hardness meter.

4. The three-piece solid golf ball of claim 1 wherein said cover has a gage of 0.2 to 3 mm and a specific gravity of 0.9 to less than 1.2.

5. The three-piece solid golf ball of claim 1 wherein said solid core is formed of a cis-1,4-polybutadiene base elastomer and has a diameter of 34 to 41 mm.

6. The three-piece solid golf ball of claim 1 wherein the dimples in the ball surface total in number to 360 to 450 and include at least two types of dimples having different diameters, and an index (Dst) of overall dimple surface area given by the following expression is at least 4, $$Dst = \frac{n \sum_{k-1}^{n} [(Dmk^2 + Dpk^2) x V_0 k x Nk]}{4R^2}$$

wherein R is a ball radius, n is the number of dimple types ($n \geqq 2$), Dmk is a diameter of dimples k, Dpk is a depth of dimples k, Nk is the number of dimples k wherein k=1, 2, 3, . . . n, and $V_O$, is the volume of the dimple space below a plane circumscribed by the dimple edge divided by the volume of a cylinder whose bottom is the plane and whose height is the maximum depth of the dimple from the bottom.

* * * * *

UNITED STATES PATENT AND TRADEMARK OFFICE

CERTIFICATE OF CORRECTION

PATENT NO. : 5,782,707
DATED : July 21, 1998
INVENTOR(S) : Hisashi Yamagishi et al.

It is certified that error appears in the above-identified patent and that said Letters Patent is hereby corrected as shown below:

Please add claims 7-17 as follows:

7. The three-piece solid golf ball of claim 6 wherein Dmk is in the range of 2.2 to 4.5 and Dpk is in the range of 0.12 to 0.23 mm.

8. The three-piece solid golf ball of claim 6 wherein $V_0$ is in the range of 0.39 to 0.6.

9. The three-piece solid golf ball of claim 1 wherein said core center hardness is in the range of 60 to 73 as measured on JIS-C.

10. The three-piece solid golf ball of claim 1 wherein said core has a surface hardness in the range of 70 to 83 degrees on JIS-C.

11. The three-piece solid golf ball of claim 1 wherein said core surface hardness is higher than the center hardness by 10 to 18 degrees.

12. The three-piece solid golf ball of claim 1 wherein said solid core has a distortion in the range of 2.5 to 4.5 mm under an applied load of 100 kg.

13. The three-piece solid golf ball of claim 1 wherein said intermediate layer has a hardness in the range of 75 to 100 degrees measured on JIS-C.

14 The three-piece solid golf ball of claim 1 wherein said intermediate layer has a hardness higher than the core surface hardness by t to 20 degrees.

15. The three-piece solid golf ball of claim 1 wherein said cover has a hardness in the range of 70 to 90 degrees measured on JIS-C.

UNITED STATES PATENT AND TRADEMARK OFFICE

CERTIFICATE OF CORRECTION

PATENT NO. : 5,782,707
DATED : July 21, 1998
INVENTOR(S) : Hisashi Yamagishi et al.

It is certified that error appears in the above-identified patent and that said Letters Patent is hereby corrected as shown below:

16. The three-piece solid golf ball of claim 1 wherein the gage of the intermediate layer and the cover combined is in the range of 2 to 4.5 mm.

17. The three-piece solid golf ball of claim 1 wherein said dimples occupy 63 to 85% of the ball surface Signed and Sealed this Sixth Day of November, 2001

*Attest:*

Nicholas P. Godici

NICHOLAS P. GODICI

*Attesting Officer*

*Acting Director of the United States Patent and Trademark Office*